US010101113B2

(12) United States Patent
Iwasawa

(10) Patent No.: US 10,101,113 B2
(45) Date of Patent: Oct. 16, 2018

(54) BULLET SUPPLY PORT OPENING-CLOSING DEVICE IN SIMULATION GUN

(71) Applicant: TOKYO MARUI CO, LTD., Tokyo (JP)

(72) Inventor: Iwao Iwasawa, Tokyo (JP)

(73) Assignee: TOKYO MARUI CO., LTD., Tokyo (JP)

( * ) Notice: Subject to any disclaimer, the term of this patent is extended or adjusted under 35 U.S.C. 154(b) by 0 days.

(21) Appl. No.: 15/560,565

(22) PCT Filed: Mar. 24, 2015

(86) PCT No.: PCT/JP2015/058937
§ 371 (c)(1),
(2) Date: Sep. 22, 2017

(87) PCT Pub. No.: WO2016/151766
PCT Pub. Date: Sep. 29, 2016

(65) Prior Publication Data
US 2018/0106574 A1 Apr. 19, 2018

(51) Int. Cl.
*F41B 11/00* (2013.01)
*F41B 11/57* (2013.01)
*F41B 11/71* (2013.01)

(52) U.S. Cl.
CPC ..... *F41B 11/57* (2013.01); *F41B 11/71* (2013.01)

(58) Field of Classification Search
CPC ..... F41B 11/55; F41B 11/57; F41B 11/642; F41B 11/646; F41B 11/723
(Continued)

(56) References Cited

U.S. PATENT DOCUMENTS 5,878,734 A * 3/1999 Johnson ..... F41B 11/54 124/59
6,279,562 B1 * 8/2001 Clayton ..... F41B 9/0018 124/59
(Continued)

FOREIGN PATENT DOCUMENTS

JP 03-221793 9/1991
JP 2000-295379 10/2000
(Continued)

OTHER PUBLICATIONS

International Search Report dated Jun. 16, 2015.

*Primary Examiner* — Alexander Niconovich
(74) *Attorney, Agent, or Firm* — Jacobson Holman, PLLC.

(57) ABSTRACT

Provided is a bullet supply port opening-closing device in a simulation gun which includes a communication member that causes the nozzle to retract in response to an operation of a movable portion of the piston cylinder mechanism and transmits the movable portion to the nozzle in order to open a bullet supply port in front of the nozzle. The communication member is a plurality of divided parts on the movable portion side and the nozzle side. A nozzle side part and a movable portion side part are configured to be engaged with and disengaged from each other by an engagement mechanism such that they retract so as to open the bullet supply port for a certain time, and the movable portion side part advances so as to be integrated with the nozzle side part.

5 Claims, 13 Drawing Sheets

(58) Field of Classification Search
USPC ..... 124/45, 51.1, 66, 73, 74, 76
See application file for complete search history.

(56) References Cited

U.S. PATENT DOCUMENTS

| | | | | |
|---|---|---|---|---|
| 7,267,119 | B2 * | 9/2007 | Maeda | F41B 11/723 124/73 |
| 7,841,329 | B2 * | 11/2010 | Yang | F41B 11/646 124/66 |
| 7,950,381 | B2 * | 5/2011 | Maeda | F41B 11/54 124/45 |
| 8,091,542 | B2 * | 1/2012 | Hu | F41B 11/57 124/77 |
| 8,156,930 | B2 * | 4/2012 | Hu | F41A 17/36 124/51.1 |
| 8,567,378 | B2 * | 10/2013 | Nugent | F41B 11/55 124/56 |
| 8,662,063 | B2 * | 3/2014 | Hu | F41B 11/57 124/32 |
| 9,121,660 | B2 * | 9/2015 | Yang | F41B 11/646 |
| 2006/0231083 | A1 * | 10/2006 | Tsurumoto | F41A 19/66 124/66 |
| 2007/0289586 | A1 * | 12/2007 | Tsurumoto | F41B 11/55 124/73 |

FOREIGN PATENT DOCUMENTS

| | | |
|---|---|---|
| JP | 2005-121300 | 5/2005 |
| JP | 2007-120920 | 5/2007 |
| JP | 2013-083403 | 5/2013 |
| JP | 3191682 | 7/2014 |

* cited by examiner

BULLET SUPPLY PORT OPENING-CLOSING DEVICE IN SIMULATION GUN

TECHNICAL FIELD

The present invention relates to a bullet supply port opening-closing device in a simulation gun which generates compressed air by operating a piston cylinder mechanism, blasts a bullet loaded in a barrel with the compressed air from a nozzle, and shoots the bullet.

BACKGROUND ART

There are various types of guns classified as simulation guns, which have been changing from leisure pursuits. The change is considered to be accompanied by results that the simulation guns are very safe for not using gunpowder and development of the simulation guns of high quality and high precision is evaluated. As means for complementing real guns, the simulation guns are in wide use for the purpose of a drill and the like in police and the Self-Defense Forces. As simulation guns suitable for this purpose, there are gas guns using compressed gas, air guns using compressed air generated by a piston cylinder mechanism, and the like. The air guns include electric guns operated by an electric mechanism in addition to manually operated guns.

In electric guns, a piston cylinder mechanism is driven by an electric motor serving as a power source. As a result, a bullet is shot with generated compressed air. Such electric guns have been improved based on the invention relating to an automatic air gun that is disclosed in JP-A-3-221793 (JP-B-7-43238) and is developed by the applicant of this application. The electric gun according to the aforementioned invention has a configuration as follows. Bullets are supplied during a series of operations. There is provided a bullet supply port 7 for supplying bullets one shot at a time from the side to a bullet supply chamber in front of an air-blast port provided in a cylinder. Meanwhile, a shutter that opens and closes the bullet supply port 7 is disposed so as to be able to reciprocate. An engagement portion is provided on the rotary gear which is separated from a rotary shaft of the gear by a certain radius, and engagement means engaging with the engagement portion, and the shutter are linked by a slide arm. The slide arm is biased in a slide direction by a spring.

In this manner, in the electric guns, since the bullet supply port is open by being interconnected to the piston cylinder mechanism, an open time of the bullet supply port is merely a short moment during one rotation of the rotary gear. Due to the configuration, one bullet being pushed from a magazine in a bullet supply direction can be sent through the bullet supply port. However, in a case of a simulation gun having a form different from that described above, there are cases where the open time which can be acquired through a method in the related art is not sufficient for sending all the bullets to the bullet supply port. For example, in an electric gun including an electrically operated compressed air generating unit that has a plurality of barrels and blasts each bullet with air in order to shoot the bullet disposed in a cartridge portion of each barrel, since there is one passage for the bullet to be supplied to the cartridge portion of each barrel, a time corresponding to the number of barrels is required in supplying bullets.

In order to lengthen the open time for the bullet supply port, there is a method of taking a long retracting time of a nozzle. As an example thereof, JP-A-2007-120920 (Japanese Patent No. 4745021) discloses an invention which relates to a nozzle portion driving mechanism. However, in this invention, due to the restriction that a sector gear has to be reduced in size, an attempt is made by adjusting the length of a second teeth in a rotations direction. Although there is no problem when supplying one bullet, it becomes difficult to cope with a case of supplying a plurality of bullets. Moreover, since the nozzle has a structure being integrated with a tappet member, when the stroke of the tappet member becomes long, the moving distance of the nozzle also has to be long. Therefore, the nozzle is also increased in size, resulting in a problem of a space and a problem of a loss during compression, for example, an extended time for generated compressed air to reach the bullet in the cartridge portion. In a case of using bullets of 6 mm, that is, so-called airsoft pellets, the simulation gun is regulated by the regulations such as Article 1-2 in the Firearms and Swords Control Act prohibiting kinetic energy at a particular point of measurement from exceeding 3.5 J/cm$^2$. The aforementioned problems are not an obstacle when complying with the relative regulations. However, when power is weakened more than necessary, it is no longer attractive as a product and is not preferable. Products ought to satisfy the required demands at all times.

CITATION LIST

Patent Literature

[PTL 1] JP-A-3-221793

[PTL 2] JP-A-2007-120920

SUMMARY OF INVENTION

Technical Problem

The present invention has been made in consideration of the foregoing circumstances, and an object thereof is to minimize a retracting amount of a nozzle and to maximally shorten an open time for a bullet supply port. In addition, another object of the present invention is to provide a device in which a communication member causing a movable portion side and the nozzle of a piston cylinder mechanism to communicate with each other is divided, even though a movable portion side part continues to retract, a nozzle side part is isolated after the lapse of certain time required for the bullet supply port being open, and while the nozzle remains to have an approximately shortest length, the open time for the bullet supply port is adjustable.

Solution to Problem

In order to attain the above-described objects, according to the present invention, there is provided means for a bullet supply port opening-closing device in a simulation gun which generates compressed air by operating a piston cylinder mechanism, blasts a bullet loaded in a barrel with the compressed air from a nozzle, and shoots the bullet. The bullet supply port opening-closing device includes a communication member that causes the nozzle to retract in response to an operation of a movable portion of the piston cylinder mechanism and transmits the operation of the movable portion to the nozzle in order to open a bullet supply port leading to a space in front of the nozzle. The communication member is constituted by a plurality of divided parts on the movable portion side and the nozzle side. A nozzle side part and a movable portion side part are configured to be able to be engaged with and disengaged from each other by an engagement mechanism such that the nozzle side part and the movable portion side part integrally retract so as to open the bullet supply port, after the nozzle side part is isolated from the movable portion side part which continues to retract, an open state is retained for a certain time, and the movable portion side part advances so as to be integrated with the nozzle side part.

The simulation guns, in which the bullet supply port opening-closing device according to the present invention is applied, are required to include the piston cylinder mechanism. Electric guns are typical examples of simulation guns including the piston cylinder mechanism. However, the present invention is targeted not only at the electric guns. It is needless to mention that the present invention can also be applied to simulation guns having a different structure. In addition, the present invention is also preferable for the type of simulation guns having a plurality of barrels. For example, JP-A-11-94495 (Japanese Patent. No. 3045984) discloses such a simulation gun as an invention of a cartridge device for multiple gun barrels. The configuration thereof can also be applied to a cartridge part of the present invention.

The device of the present invention includes the communication member that causes the nozzle to retract in response to an operation of the movable portion of the piston cylinder mechanism and transmits the operation of the movable portion to the nozzle in order to open the bullet supply port leading to the space in front of the nozzle. Since the communication member causes the nozzle to retract in response to an operation of the movable portion of the piston cylinder mechanism and opens the bullet supply port leading to the space in front of the nozzle, the communication member functions similarly to a member called a tappet or a tappet member in the related art. However, the communication member is not a member having a single structure. The communication member is constituted by the plurality of divided parts on the movable portion side and the nozzle side.

The nozzle side part and the movable portion side part are configured to be able to be engaged with and disengaged from each other by the engagement mechanism such that the nozzle side part and the movable portion side part integrally retract so as to open the bullet supply port, after the nozzle side part is isolated from the movable portion side part which continues to retract, the open state is retained for the certain time, and the movable portion side part advances so as to be integrated with the nozzle side part. When the nozzle side part is isolated from the movable portion side part, it is possible to set the retracting amount of the nozzle to be minimized and the open time for the bullet supply port to be maximally shortened. The minimized retracting amount of the nozzle indicates a retracting amount required for one bullet to pass through.

It is preferable that the communication member engages with the movable portion of the piston cylinder mechanism, a latch member which retracts together with the movable portion is included in the movable portion side part, and the nozzle side part configures a nozzle base having an inter-nozzle which is slidable in an air-tight manner with respect to the nozzle provided in a front portion of the piston cylinder mechanism. When the inter-nozzle is provided, it is possible to perform opening the bullet supply port, pushing in the bullet, and the like without going through an air-blast nozzle of the piston cylinder mechanism.

The engagement mechanism may be configured to include an engagement portion provided in the nozzle side part and a disengagement portion provided on a gun main body side, the disengagement portion may be positioned in a position at a predetermined distance behind a position of an advancing limit when the nozzle side part is present in the advancing limit, a distance between the positron of the advancing limit where the nozzle side part is present and the position of the disengagement portion may be maximally shortened, and a retention time for the open state of the bullet supply port may be minimized. That is, according to the present invention, the open time for the bullet supply port can be substituted by the distance between the position of the advancing limit in the nozzle side part and the position of the disengagement portion.

The present invention is particularly preferable for a simulation gun which has a plurality of barrels and in which a certain time for a bullet supply port being open is a time required for the plurality of barrels to be loaded with a bullet. In the plurality of barrels, the bullet is supplied through the bullet supply port in a rear end portion thereof one shot at a time. As a specific configuration thereof, the invention relating to the cartridge device for multiple gun barrels in the related art can be applied as described above.

Advantageous Effects of Invention

Since the present invention is configured and operates as described above, while the retracting amount of the nozzle remains to be minimized, the open time for the bullet supply port can be adjustable, thereby exhibiting the effect that the bullet supply port can be open for a time required for a plurality of bullets to be supplied, with one operation of the piston cylinder mechanism. In addition, according to the present invention, it is possible to provide a device in which the communication member causing the movable portion side and the nozzle of the piston cylinder mechanism to communicate with each other is divided, even though the movable portion side part continues to retract, the nozzle side part is isolated after the lapse of certain time required for the bullet supply port being open, and while the nozzle remains to have the minimized retracting amount, the open time for the bullet supply port is adjustable.

BRIEF DESCRIPTION OF THE DRAWINGS

FIG. 4 consists of FIGS. 4A and 4B and illustrates the cylinder assembly according to the invention.

FIG. 10 consists of FIGS. 10A and 10B and is an enlarged view illustrating an engagement mechanism according to the invention.

FIG. 11 consists of FIGS. 11A and 11B and illustrates an operation of the simulation gun in which the bullet supply port opening-closing device according to the invention is applied.

FIG. 12 consists of FIGS. 12A and 12B and illustrates an operation according to the invention.

FIG. 13 consists of FIGS. 13A and 13B and illustrates an operation according to the invention.

REFERENCE NUMBERS

10 Compressed Air Generating Unit
11, 12, 13 Barrel
14 Cartridge Portion
15 Sight Mechanism
16 Connection Gasket
17 Trigger
18 Switch
19 Outer Barrel
20 Cylinder Assembly
21, 22, 23 Cylinder
24 Blast Nozzle
25 Pipe Member
26 Front Fixing Member
27 Rear Fixing Member
28 Inter-Nozzle
29 Nozzle Base
30 Piston Assembly
31, 32, 33 Piston
34 Joint Portion
35 Piston Shaft
36 Rack
37 Rod
38 Seal Member
39 Gear Disposition Space
40 Electric Mechanism
41 Sector Gear
42 Elastic Member
43 Electric Motor
44 Pinion
45 Reduction Gear Set
46 Piston Movement Portion
47 Guide Groove
48 Selector
49 Latch Member
50 Cartridge Assembly
51 Magazine
53 Bullet Supply Unit
54 Receiving Member
55 Receiving Portion
56 Spring
60 Bullet Supply Port Opening-Closing Device
61 Movable Portion
62 Bullet Supply Port
63 Communication Member
64 Engagement Portion
65 Engagement Mechanism
66 Disengagement Portion
67 Engagement End
68 Engagement Counterpart Portion
69 Spring
70 Protruding Shaft

DETAILED DESCRIPTION OF THE INVENTION

Figure 1:
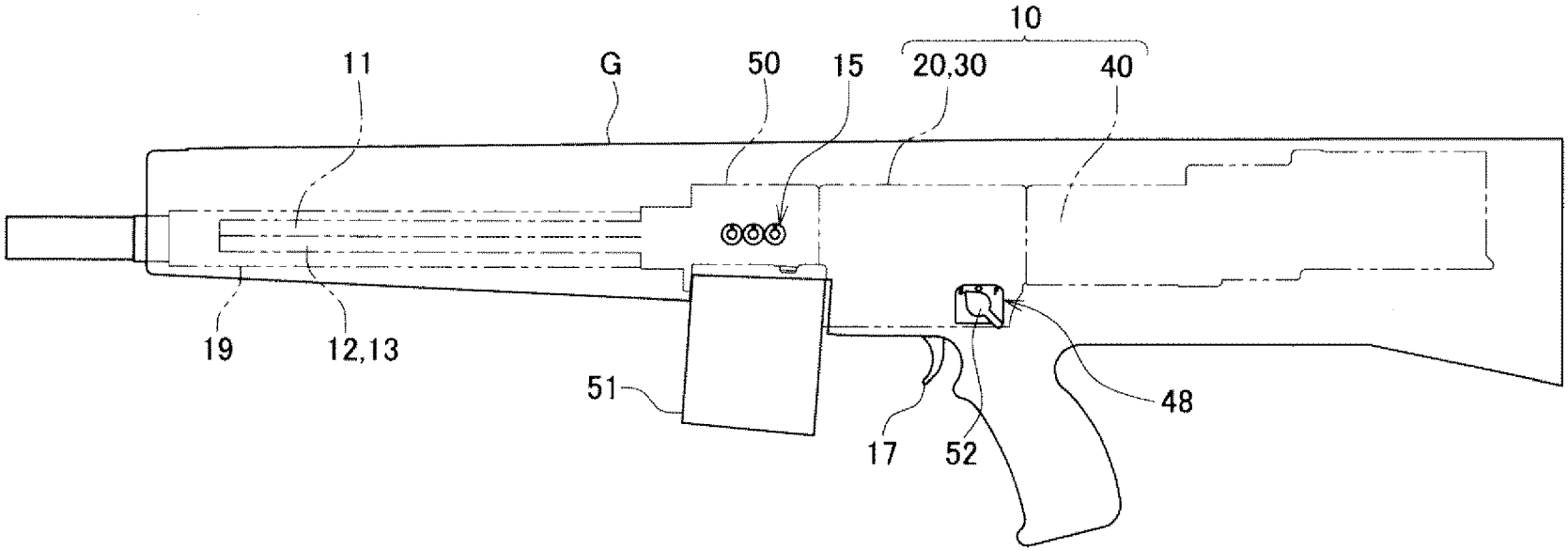
FIG. 1 is a side view illustrating an example of a simulation gun in which a bullet supply port opening-closing device according to the present invention is applied.

Hereinafter, with reference to the illustrated embodiment, the present invention will be described in more detail. FIG. 1 illustrates a simulation gun G in which a bullet supply port opening-closing device according to the present invention is applied. As the simulation gun G, a multi-bullet shooting electric gun is illustrated. The simulation gun G includes three barrels 11, 12, 13 as an example of a plurality thereof. Therefore, a compressed air generating unit 10 is configured to have a cylinder assembly 20 constituted by three cylinders 21, 22, 23, a piston assembly 30 constituted by three pistons 31, 32, 33, and an electric mechanism 40 driving the piston assembly 30 (refer to FIG. 2 and the like).

Figure 7:
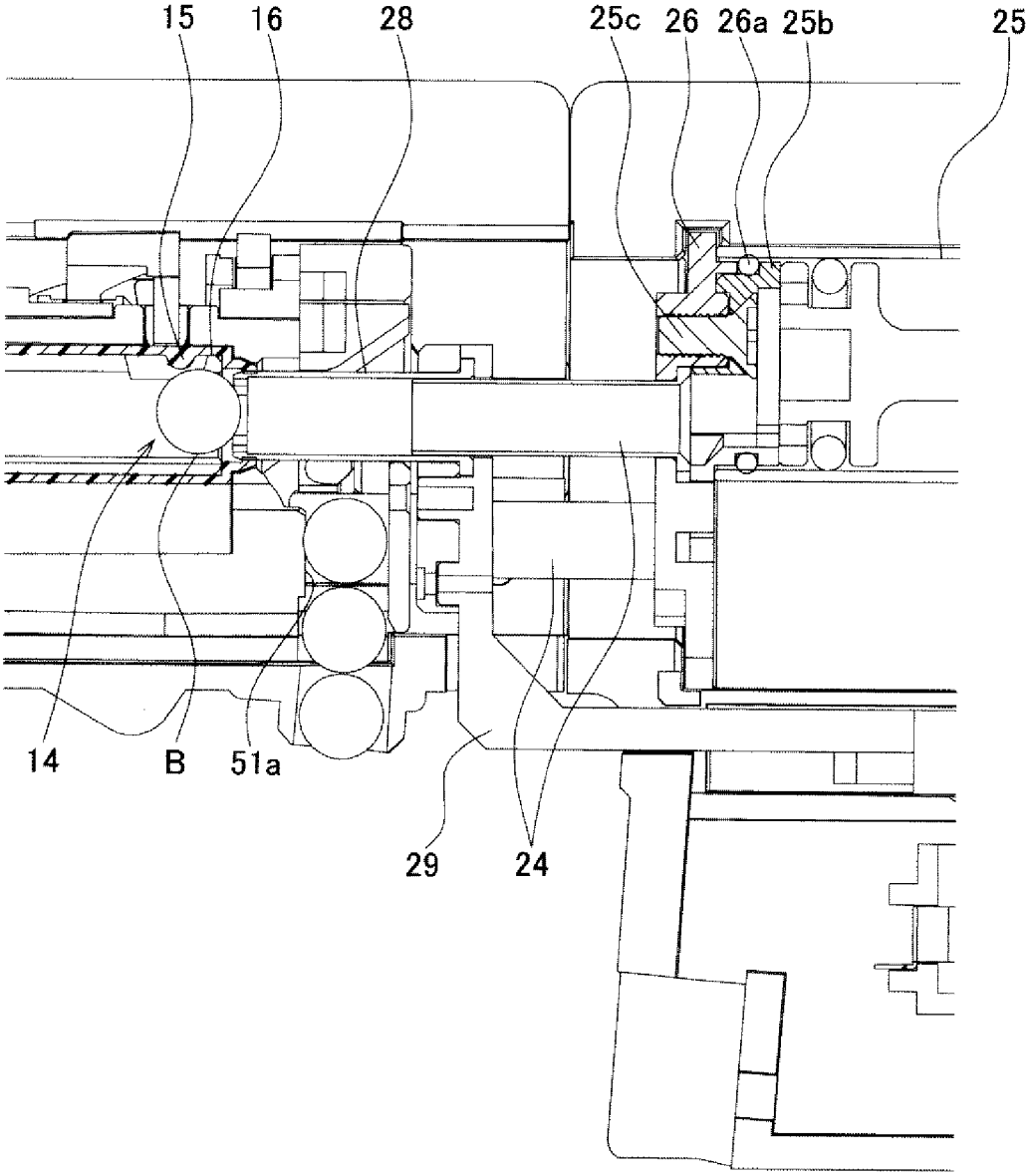
FIG. 7 is an enlarged sectional view illustrating a part from the cylinder assembly to a cartridge assembly according to the invention.

A cartridge assembly 50 is provided in a rear portion of the barrels, and a detachable magazine 51 is mounted at a lower portion thereof. A cartridge portion 14 is set in the cartridge assembly 50, so that a bullet B is disposed inside the rear end of each of the three barrels 11, 12, 13. The cartridge portion 14 is provided with a sight mechanism 15 for adjusting a trajectory. In addition, a connection gasket 16 covers the outside of the rear ends of the three barrels 11, 12, 13. The connection gasket 16 is formed of a soft material such as rubber, having seal performance (refer to FIGS. 2 and 7).

The compressed air generating unit 10 is a part generating air with which the bullet B is blasted in order to shoot each bullet B from each of the barrels 11, 12, 13 in the multi-bullet shooting electric gun G. The barrels themselves are combined such that three thereof form a triangle shape when seen from the front. The compressed air generating unit 10 is disposed at the rear inside the electric gun G. The cylinder assembly 20, the piston assembly 30, and the electric mechanism 40 configuring the compressed air generating unit 10 are disposed in an approximately straight line in order thereof.

Figure 3:
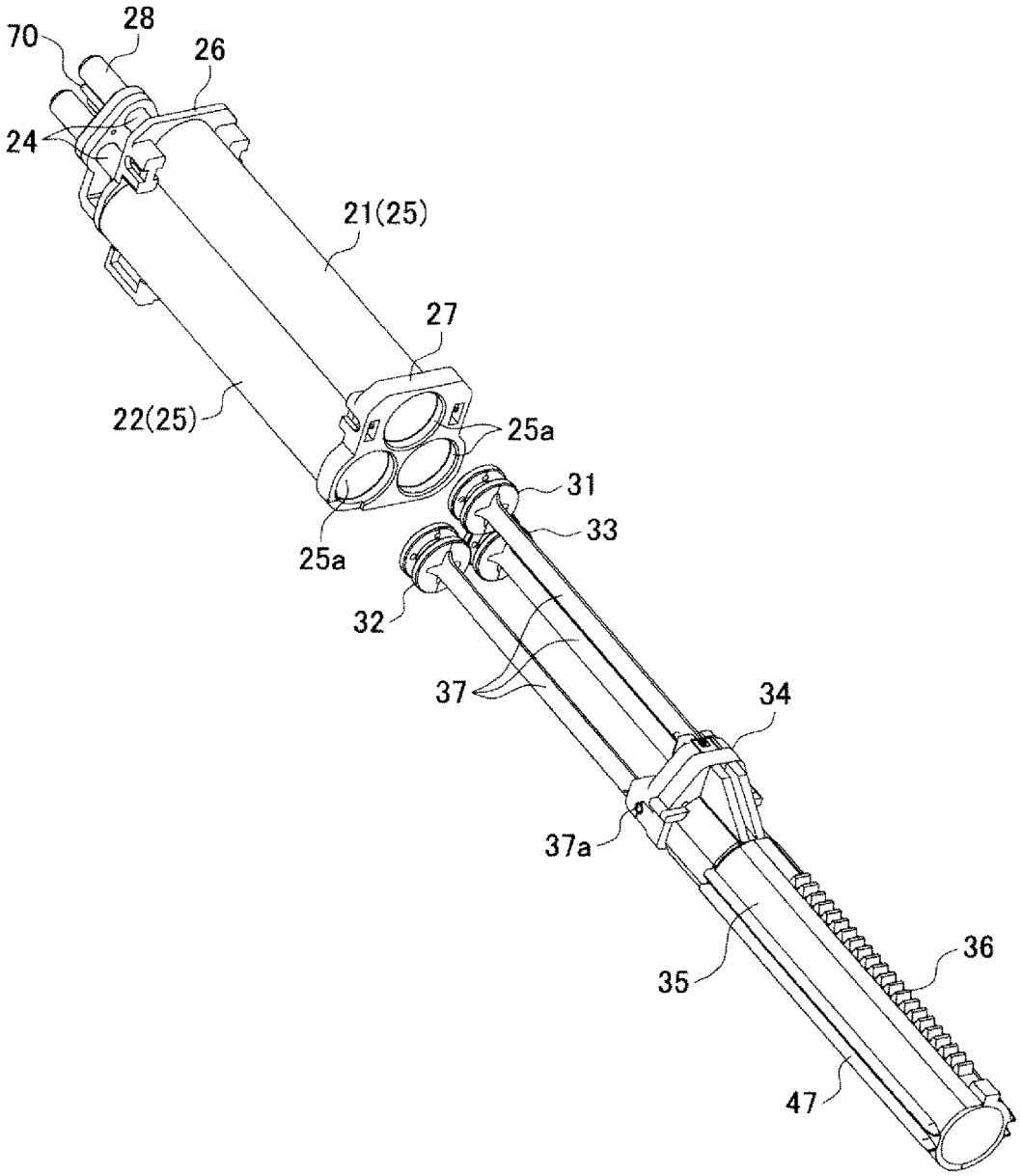
FIG. 3 is an exploded perspective view illustrating a cylinder assembly and a piston assembly according to the invention.
Figure 4A:
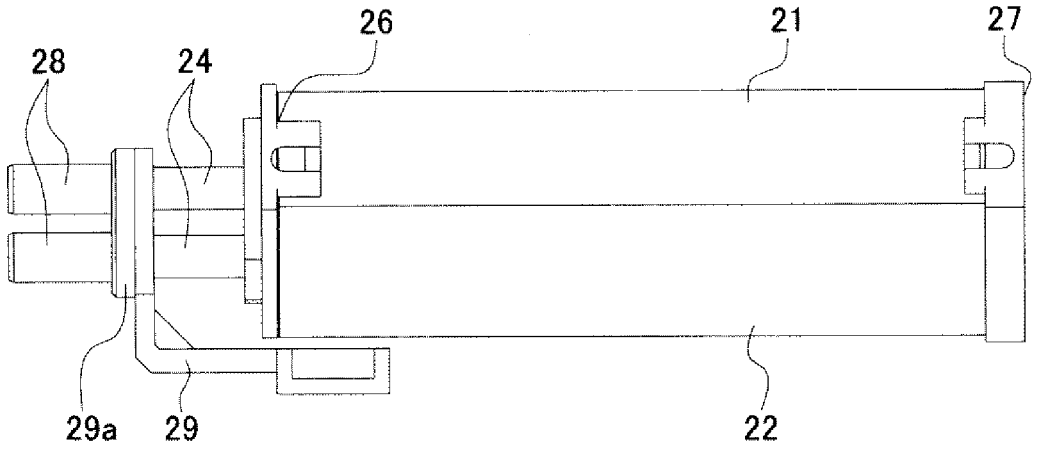
FIG. 4A illustrates a side view.

The cylinder assembly 20 is positioned in a rear portion of the three barrels 11, 12, 13, has air-blast nozzles 24 at the tip end, and has the three cylinders 21, 22, 23 in which the pistons 31, 32, 33 respectively reciprocate. The illustrated cylinder assembly 20 is configured to have three pipe members 25, a front fixing member 26 fixing each of the pipe members 25 to a tip end portion, and a rear fixing member 27 fixing each of the pipe members 25 to a rear end portion (refer to FIGS. 3 and 4).

Figure 4B:
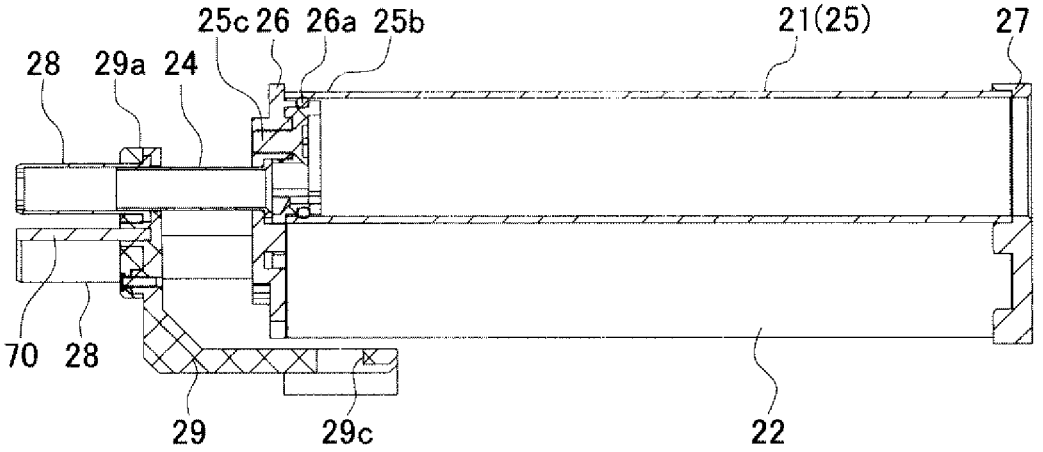
FIG. 4B illustrates a longitudinal sectional view taken along a central line.
Figure 5:
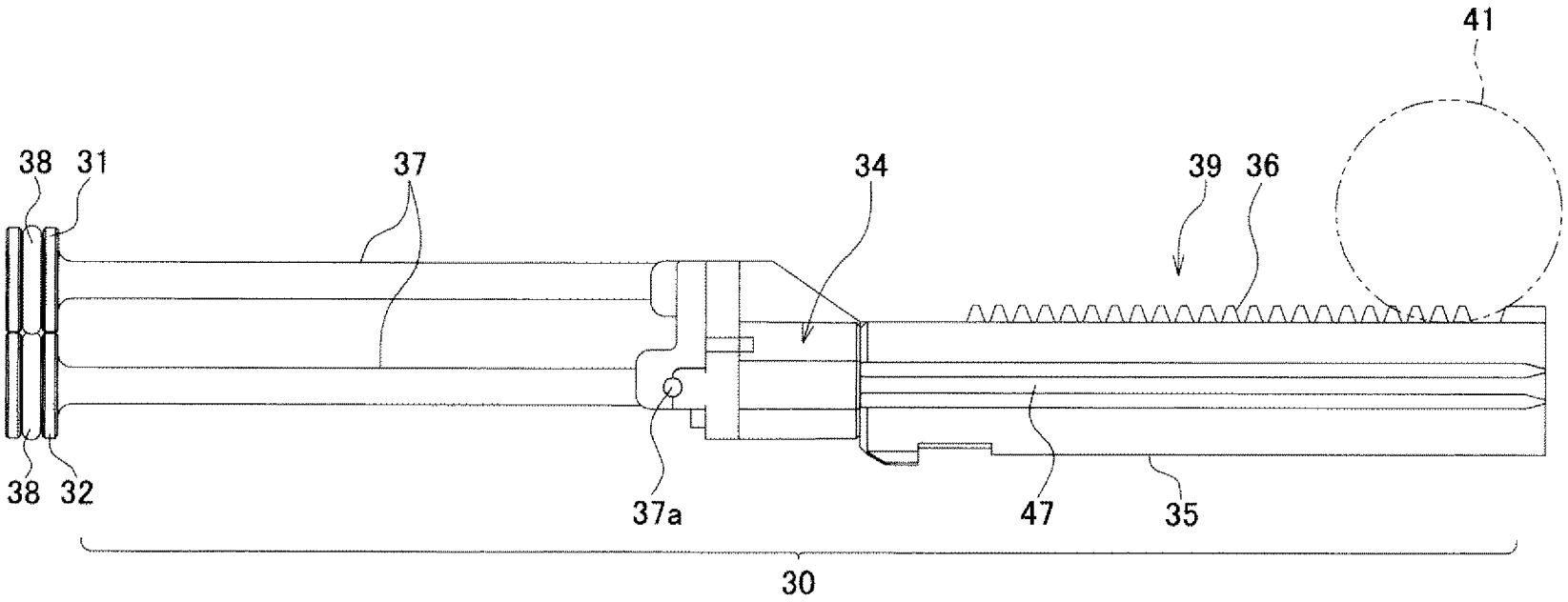
FIG. 5 is a side view illustrating the piston assembly according to the invention.

The air-blast nozzles 24 are provided in the front fixing member 26, and an insertion port 25*a* for the piston is open in the rear fixing member 27. The blast nozzles 24 are provided in front of a pipe attachment member 25*b*, and the pipe attachment member 25*b* is attached to the rear surface of the front fixing member 26 by a fastener 25*c*. The pipe attachment member 25*b* has a positional relationship with the pipe member 25 in which the pipe attachment member 25*b* is fitted, and is assembled in an air-tight manner by using seal means 26*a* (FIG. 4B).

As seen in the illustrated embodiment, an inter-nozzle 28 is disposed between the cartridge portion 14 and the air-blast nozzles 24. The inter-nozzle 28 is provided to be movable in the forward-rearward direction by a nozzle base 23. The inter-nozzle 28 slides with respect to the blast nozzle 24 in an air-tight manner and is at a position where a bullet is blasted with compressed air generated in the compressed air generating unit 10. The inter-nozzle 28 is attached to an erected portion 23*a* of the nozzle base 29 and is incorporated in a main body of the simulation gun G so as to be able to advance and retract. Thus, in the device of the invention of this application, the nozzle is configured to have the blast nozzle 24 and the inter-nozzle 28, and the inter-nozzle 28 corresponds to the nozzle to which an operation of a movable portion is transmitted.

Figure 2:
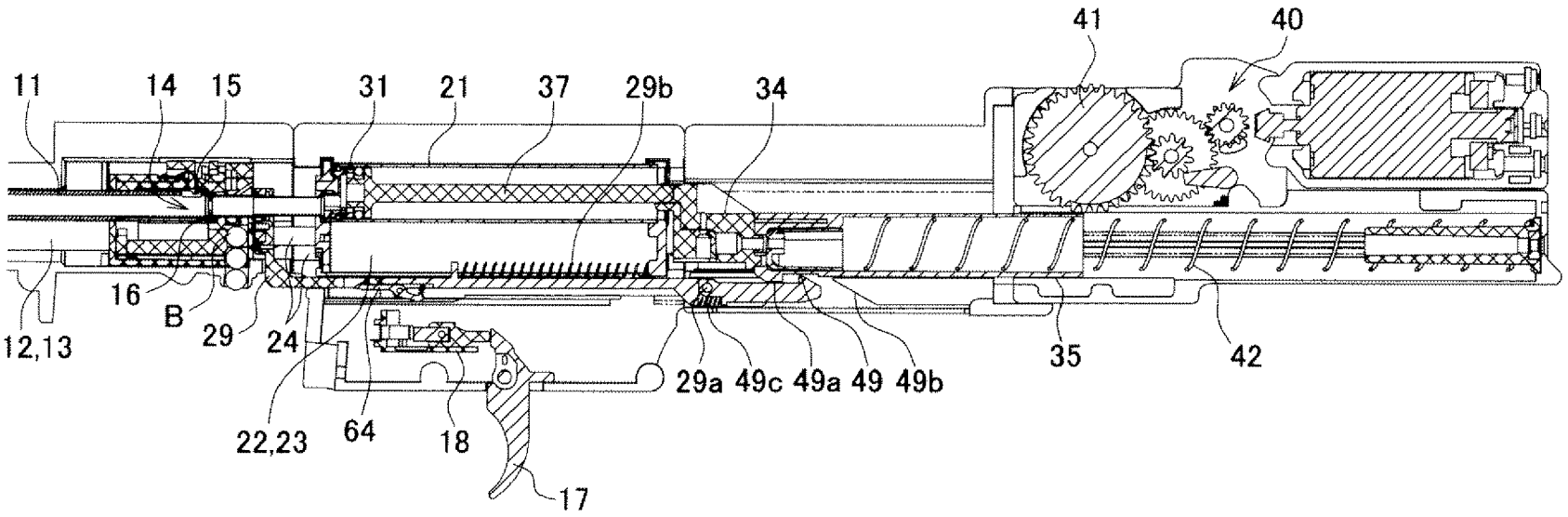
FIG. 2 is a sectional view illustrating an enlarged, main portion of the simulation gun according to the invention.

Therefore, the inter-nozzle 28 retracts by being engaged with a latch member 49, in response to retract operations of the pistons 31, 32, 33 and is caused to advance by a spring of biasing means 29*b* acting on the nozzle base 29 (refer to FIG. 2). Then, the tip end thereof is configured to also slide with respect to the connection gasket 16 in an air-tight manner, to be separated from the connection gasket 16, and to retract so as to open a gap, that is, a bullet supply port in which the bullet B is pushed up in the rear end portion of the barrel. Thereafter, the inter-nozzle 28 advances so as to push the bullet B into the cartridge portion 14.

The air-blast nozzles 24 are provided at positions leaning to the center of the pipe members 25, 25, 25 of the three cylinders 21, 22, 23. This countermeasure is provided because the air-blast nozzle 24 cannot coincide with the center of a cylinder pipe having a diameter larger than the barrel, since the number of a plurality of the barrels 11, 12, 13 in the illustrated example is three. Thus, the position of each of the air-blast nozzles 24, 24, 24 is determined based on the relationship between the barrel and the position of the center of the cylinder pipe.

The piston assembly 30 has the three pistons 31, 32, 33 which respectively reciprocate inside the cylinders 21, 22, 23 and generate compressed air. In addition, the three pistons 31, 32, 33 are configured to be bound in one place by a joint portion 34 at the rear and to be integrally provided with one piston shaft 35 having a rack 36 along a reciprocating direction and the joint portion.

The three pistons 31, 32, 33 are flexibly joined to the joint portion 34 such that seal performance between the pistons 31, 32, 33 and cylinder inner wall surfaces is maintained due to the joined state. That is, when the pistons and the cylinders configuring a piston cylinder mechanism have high precision in the positional relationship or the fitting state therebetween, it becomes easy to obtain high compressibility. Moreover, the axial centers therebetween also have to coincide with each other with high precision. However, when a certain degree of flexibility is allowed. It is possible to obtain high compressibility without requiring excessive precision.

In order to apply the flexibility, the present invention adopts a configuration in which the pistons 31, 32, 33 are respectively provided at the tip ends of slender rods 37, 37, 37, so that each of the rods 37 is movably pivoted in the joint portion 34 at the rear. In the illustrated embodiment, each of the rods 37 is pivoted with respect to the piston reciprocating direction by using a pivot 37*a* in the transverse direction. For example, all the rods 37 are configured to be movable in the vertical direction. The air-tightness of the pistons 31, 32, 33 is maintained by using the illustrated O-rings as seal members 38.

In the configuration of the embodiment in which the piston cylinder mechanism is constituted by three sets, as described above, the three sets are combined in the piston assembly 30 so as to have a triangle shape when seen from the front, the piston shaft 35 is disposed in the joint portion 34 with a positional relationship of being shifted downward from a central portion of the three sets, and the rack 36 is positioned at the top of a part which is shifted downward. Therefore, the position of the rack 36 becomes close to the central portion of the three sets. Accordingly, it is possible to gain a disposition space 39 for the electric mechanism 40 of an output gear 41, and driving force of the output gear 41 is more efficiently transmitted from a position close to the center line.

Figure 6:
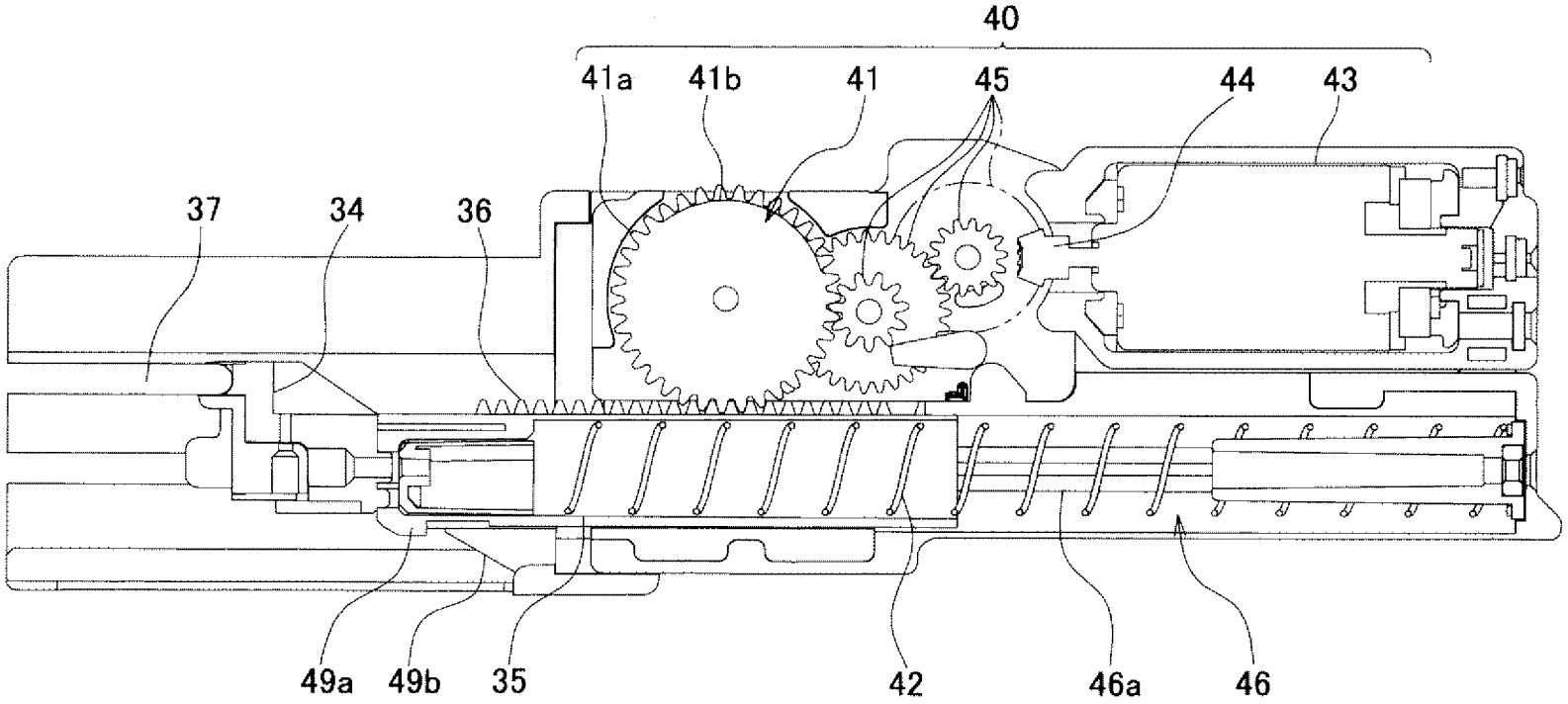
FIG. 6 is a view illustrating a part from the piston assembly to an electric mechanism according to the invention.

The electric mechanism 40 is configured to cause the piston assembly 30 to retract, to cause an elastic member 42 to accumulate pressure, and to drive the sector gear 41 meshing with the rack 36 in order to compress air by releasing the accumulated pressure. As a description with reference to FIG. 6 in detail, the reference sign 43 indicates an electric motor, that is, a motor, the reference sign 44 indicates a pinion attached to a rotary shaft thereof, and the reference sign 45 indicates a reduction gear set constituted by several gears meshing with the pinion 44. The sector gear 41 has a gear in a portion of the circumference. The sector gear 41 has a toothed portion 41*a* which meshes with the rack 36 and causes the piston assembly 30 to retract, and a non-toothed portion 41*b* which does not mesh with the rack 36 and enables the piston assembly 30 to advance.

The piston shaft 35 has a hollow structure and is biased in the advancing direction by the elastic member 42 illustrated as a coil spring which is hollow inside. One end of the elastic member 42 constituted by the coil spring is in contact with the front end of the piston shaft which is hollow inside, and the other end is supported by the rear end of the cavity which is a piston movement portion 46 provided inside the electric mechanism 40. The reference sign 47 indicates a guide portion constituted by an irregular structure. The guide portion 47 is provided in a laterally longitudinal direction of the piston shaft 35 and engages with a projection 46*a* which is an engagement counterpart constituted by an irregular structure provided on the gun main body side, thereby functioning as a guide for moving straight forward.

In addition to the description above, the multi-bullet shooting electric gun G according to the present invention includes mechanisms required for operating as an electric gun, such as a power source battery (not illustrated), a circuit connecting the power source battery and an electric motor 43, and a switch for turning on and off the power source. The reference sign 18 indicates the switch, the reference sign 19 indicates an outer barrel housing the three barrels, the reference sign 48 indicates a selector for selecting a shooting mode, and the reference sign 49 indicates the aforementioned latch member. The latch member 49 is pivoted at the rear end of the nozzle base 29 by a pivot 29*a* as vertically movable engagement means. The latch member 49 is configured to be retractable by being engaged with an engagement counterpart portion 49*a* provided in the piston shaft 35 and to be able to be disengaged by coming into contact with a disengagement portion 49*b* provided on the gun main body side. The reference sign 49*c* is a spring, which is means biasing the latch member 49 in a direction for engaging with the engagement counterpart portion 49*a* (refer to FIG. 2). The spring 29*b* is configured to act on the nozzle base 29 as forward biasing means so as to push out the supplied bullet B to the cartridge portion 14.

Figure 8:
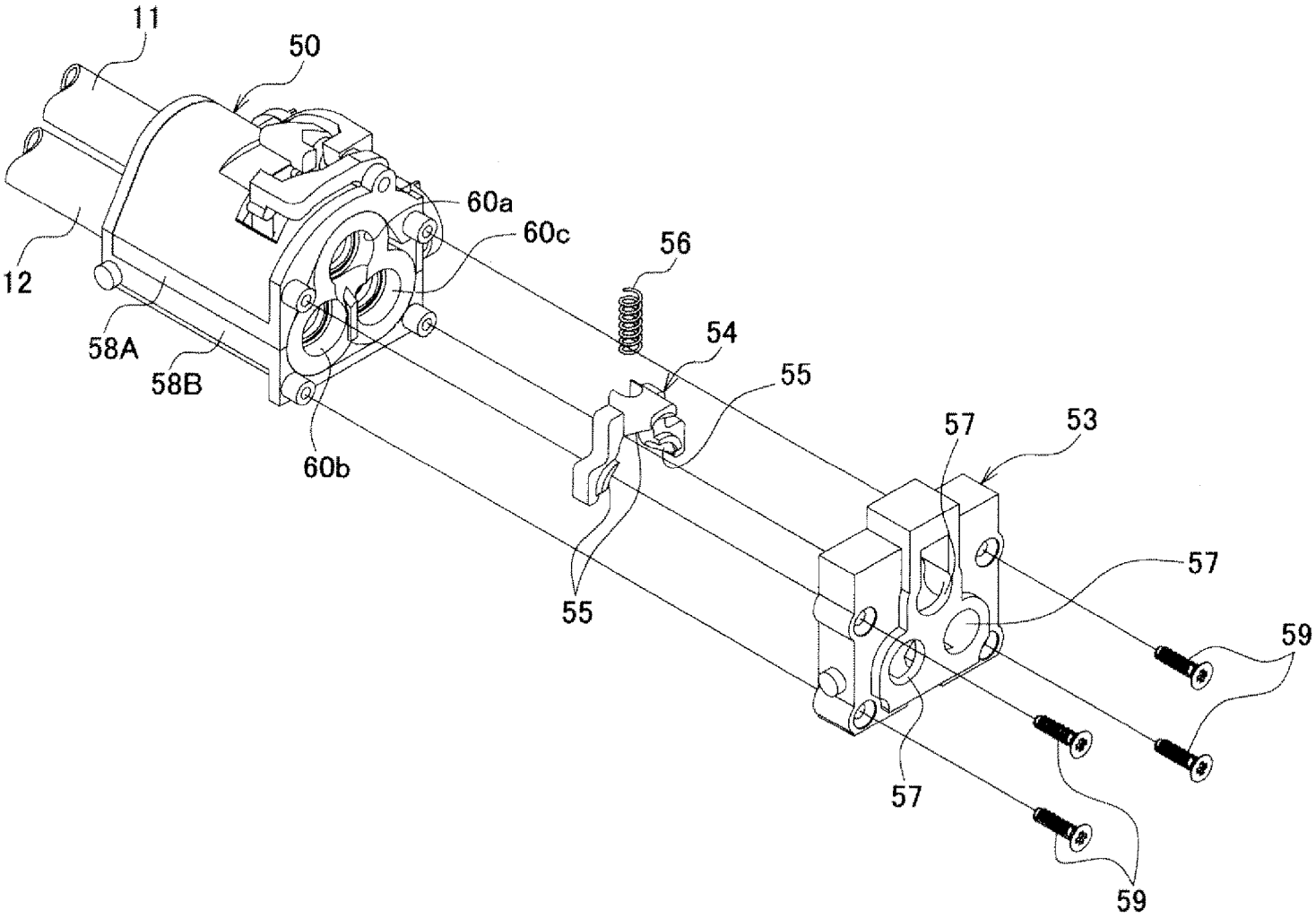
FIG. 8 is an exploded perspective view illustrating the cartridge assembly according to the invention.

A bullet supply port opening-closing device 60 in a simulation gun of the present invention is provided across the cartridge assembly 50 and the compressed air generating unit 10 positioned in the rear portion of the barrels (refer to FIGS. 1 and 2). The detachable magazine 51 is mounted in a lower portion. Through a supply passage 51*a* connected to a bullet supply port thereof, the bullet B is pushed up one shot at a time and is supplied to a bullet supply unit 53. The bullet supply unit 53 is positioned in the rear portion of the cartridge assembly 50 and internally has a receiving member 54 which receives the supplied bullet B. The receiving member 54 has three receiving portions 55, 55, 55 in total, that is, one at the top center and two at the lower right and left, each having a slope. The receiving member 54 is pushed downward by a spring 56 serving as biasing means, that is, is pushed against force of pushing up the bullet B (refer to FIG. 8). The three bullets B received in the receiving member 54 are disposed closed to each other, and two lower shots among thereof are supported by a next bullet pushed up from the supply passage 51*a*.

The bullet supply unit 53 is penetrated in the forward-rearward direction by openings 57, 57, 57 in three places. The tip end portion of the inter-nozzle 28 can be inserted into each of the openings 57. That is, the openings 57 in the three places are set such that the disposition thereof completely coincides with the cartridge portions 14 respectively positioned inside the three barrels at the rear end, and the receiving portions 55 in the three places. Therefore, when the inter-nozzle 28 advances, the receiving portions 55 in the three places are pushed up by the component of force of the slope thereof and are pushed back by the spring 56. However, in the configuration, during the push-up and push-down, three bullets become free, and the three bullets B are instantaneously pushed out by the tip end of the inter-nozzle 28, thereby being sent to the cartridge portions 14 in the rear portion of the barrels 11, 12, 13. The specific configuration of this part is also disclosed in the invention relating to a cartridge device for multiple gun barrels described above, and can be realized based on the disclosure thereof.

Figure 9:
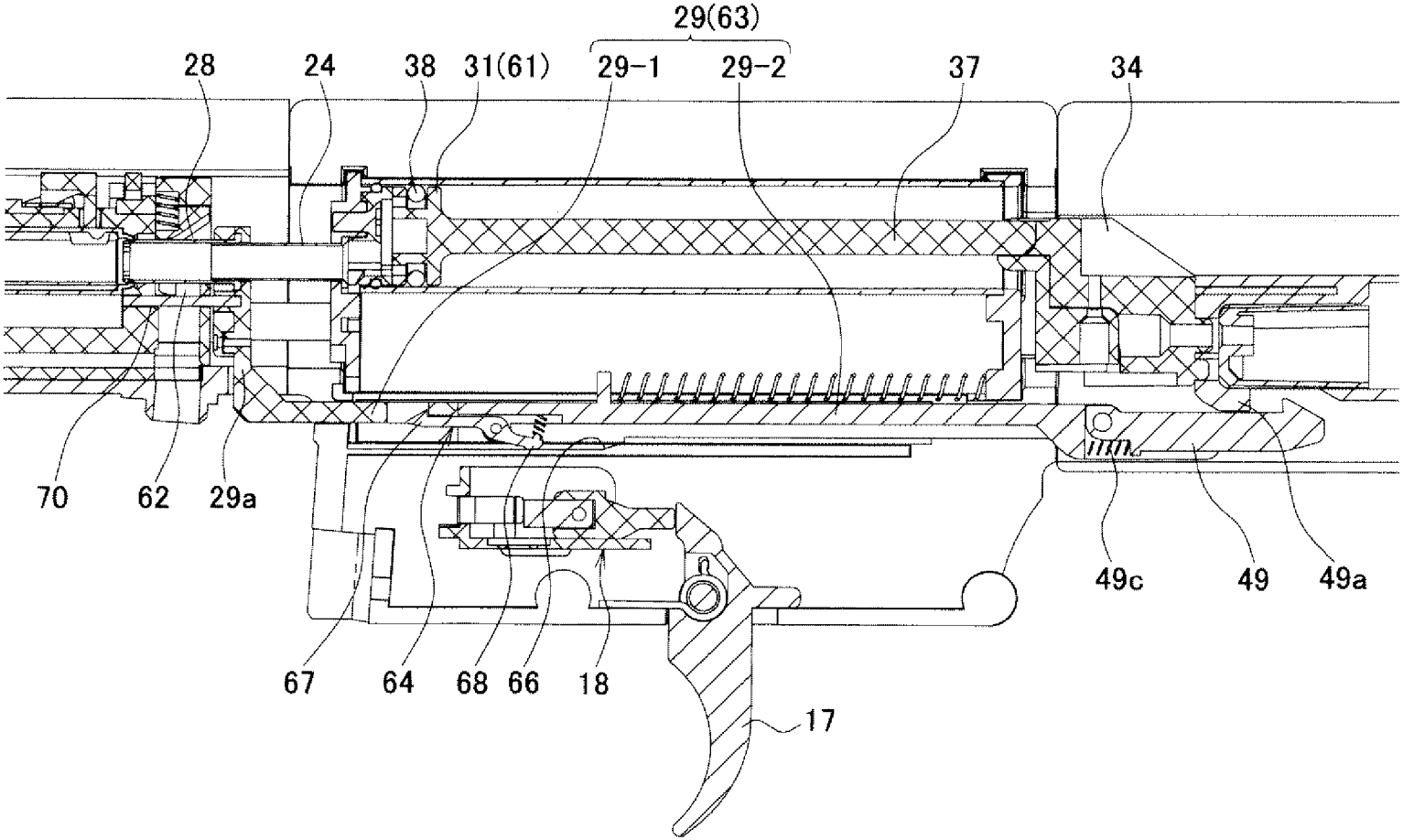
FIG. 9 is a sectional view illustrating a communication member and a relationship between the communication member and other parts according to the invention.

The bullet supply port opening-closing device 60 includes a communication member 63 that causes the nozzle to retract in response to an operation of the piston serving as a movable portion 61 of the piston cylinder mechanism and transmits the operation the movable portion 61 to the nozzle in order to open a bullet supply port 62 leading to a space in front of the nozzle. Here, the nozzle indicates the inter-nozzle 28 as mentioned above, being disposed between the cartridge portion 14 and the air-blast nozzle 24. The inter-nozzle 28 slides with respect to the cartridge portion 14 and the blast nozzle 24 in an air-tight manner slide, is at a position where a bullet is blasted with compressed air generated in the compressed air generating unit 10, and is provided so as to be movable in the forward-rearward direction by the nozzle base 29. In addition, the inter-nozzle 28 is attached to an erected portion 29*a* of the nozzle base 29 and is incorporated in a main body of the simulation gun G so as to be able to advance and retract (refer to FIG. 9).

The nozzle base 29 causing the cartridge portion 14 and the air-blast nozzle 24 to communicate with each other is used as the communication member 63. In the present embodiment, as the communication member 63, the nozzle base 29 is configured to be divided into parts 29-1, 29-2 on the nozzle side and movable portion side in the front and rear. The nozzle side part 23-1 and the movable portion side part 29-2 are configured to be able to be engaged with and disengaged from each other by an engagement mechanism 65 such that the nozzle side part 29-1 and the movable portion side part 29-2 integrally retract so as to open the bullet supply port 62. After the nozzle side part 29-1 is isolated from the movable portion side part 29-2 which continues to retract, an open state is retained for a certain time. Thereafter, the movable portion side part 29-2 advances so as to be integrated with the nozzle side part 29-1.

Figure 10A:
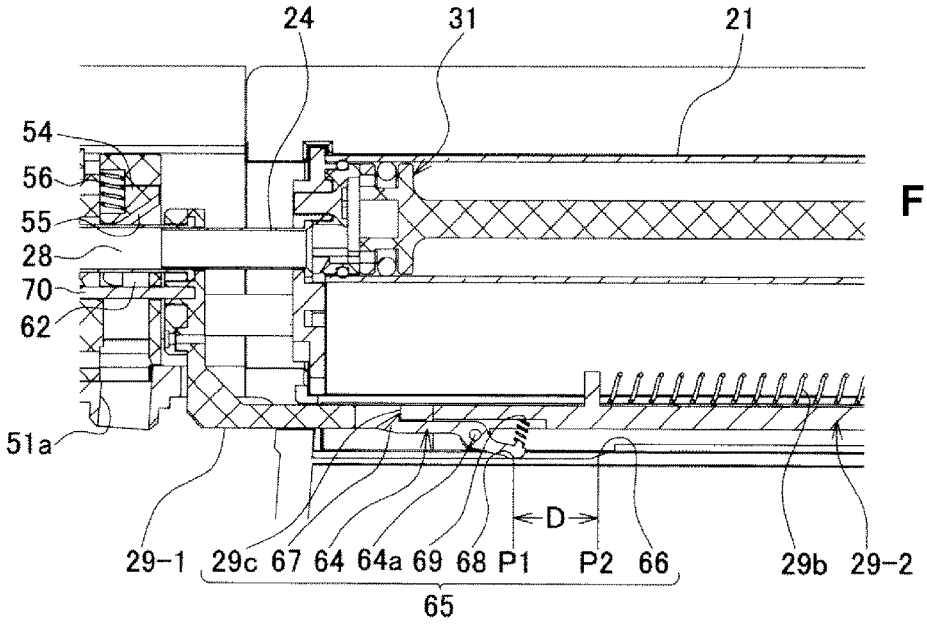
FIG. 10A is a sectional view illustrating an engagement state in standby.
Figure 10B:
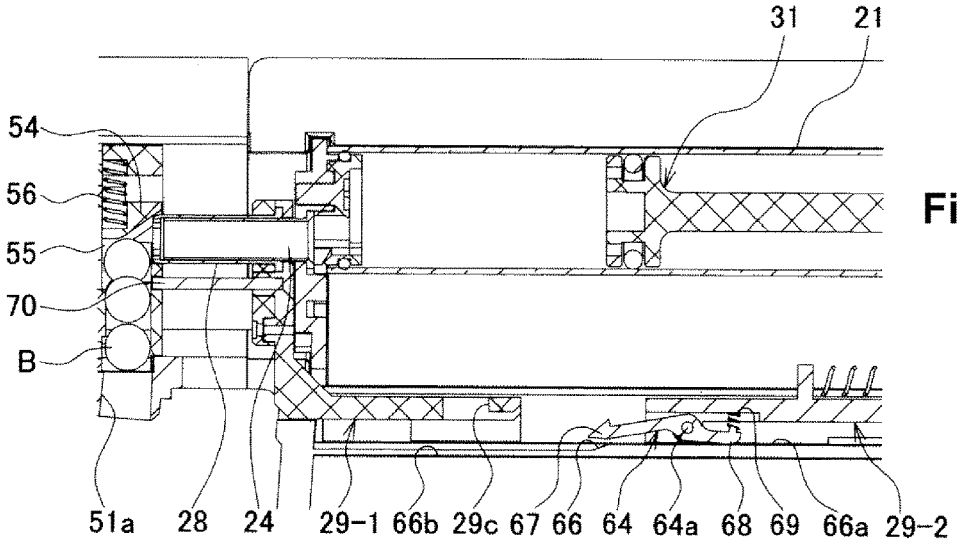
FIG. 10B is a sectional view illustrating a disengagement state.

The engagement mechanism 65 is configured to include an engagement portion 64 provided in the nozzle side part 29-1 and a disengagement portion 66 provided in the gun main body side part 29-2. The disengagement portion 66 is positioned in a position at a predetermined distance behind a position of an advancing limit when the nozzle side part 29-1 is present in the advancing limit. The engagement portion 64 is rotatably and pivotally supported by a pivot 64*a* in the movable portion side part 29-2 and engages with an engagement end 29*c* of the nozzle side part 29-1 at an engagement end 67 in the front portion thereof. In addition, the engagement portion 64 is biased by a spring 69 such that an engagement counterpart portion 68 in the rear portion thereof comes into slide contact with the gun main body side (refer to FIG. 10A). As a portion of an irregular structure, the engagement end 29*c* is formed in the vicinity of the rear end portion of the nozzle side part 29-1. A contact portion thereof with respect to the engagement end 67 is chamfered, thereby easily performing engagement again. The engagement portion 64 is pressurized by the spring 69 so as to come into slide contact with an upper stage 66*a* and a lower stage 66*b* on the gun main body side. In a state of coming into slide contact with the upper stage 66*a*, the engagement end 67 in the front portion appears to be slightly lifted (refer to FIG. 10B).

In the bullet supply port opening-closing device according to the present invention, when a distance D between a position P1 of the engagement counterpart portion 68 and a position P2 of the disengagement portion 66 in the engagement portion 64 when the nozzle side part 29-1 is at the advancing limit is the shortest, the time for the bullet supply port 62 being open and retaining the open state for a certain time is set to be minimized. Accordingly, bullets can be supplied without lengthening the time required for the plurality of barrels 11, 12, 13 to be loaded with the bullet B. When the nozzle side part 29-1 is at the advancing limit, the tip end of the inter-nozzle 28 passes through the receiving member 54 of the bullet supply unit and reaches the cartridge portion 14.

In the illustrated embodiment, the nozzles are configured to be combined such that three sets thereof form a triangle shape when seen from the front. The bullet B is supplied to a position corresponding to the center of the three sets from the bottom side of the triangle. Therefore, a protruding shaft 70 is configured to be disposed in the central portion of three inter-nozzles 28 so as to prevent the bullet B from entering. The simulation gun G has the plurality of barrels 11, 12, 13. The present invention is characterized in that a certain time for one bullet supply port being open so as to supply a bullet is a time required for the plurality of barrels 11, 12, 13 to be loaded with the bullet B.

Figure 11A:
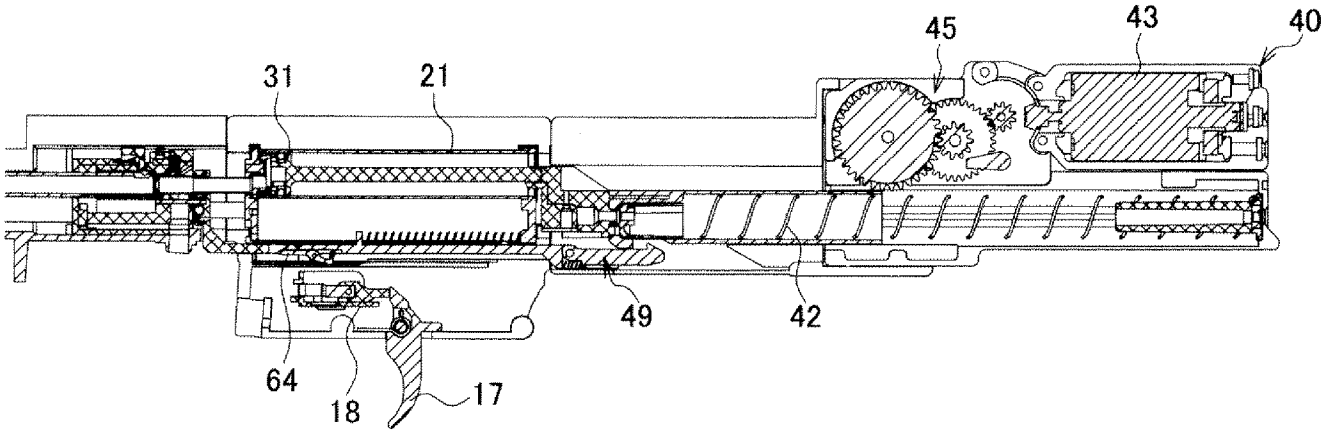
FIG. 11A is a sectional view illustrating a ready-to-shoot state.

An operation of the bullet supply port opening-closing device in a simulation gun of the present invention having such a configuration will be described. FIG. 11A illustrates a standby state. When a trigger 17 is pulled in this state, the switch 18 is turned on and the electric mechanism 40 is in an operation state by an electric circuit (not illustrated). Here, when the electric motor 43 operates and starts to rotate, the output gear 41 at the end of the reduction gear set 45 rotates. Accordingly, the rack 36 meshing with the output gear 41 starts to retract. When the three pistons 31, 32, 33 respectively retract inside the cylinders 21, 22, 23, the elastic member 42 starts being compressed in response thereto.

Figure 11B:
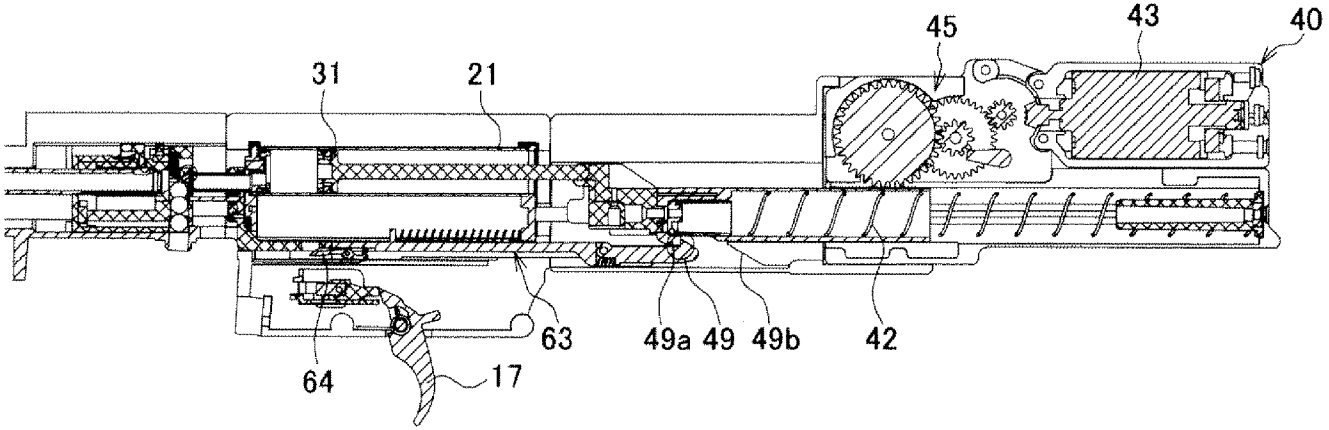
FIG. 11B is a sectional view illustrating a triggered state.

When the latch member 49 at the rear end of the communication member 63 engages with the engagement counterpart portion 49*a* in response to the retraction of the pistons 31, 32, 33, the communication member 63 starts to integrally retract. After the communication member 63 starts to retract, when the counterpart engagement portion 68 of the engagement portion 64 is caught in the disengagement portion 66, the engagement portion 64 rotates in the counterclockwise direction in the view due to cam action of the tilt surface thereof, and the nozzle side part 29-1 is disengaged from the engagement end 29*c* (FIG. 11B). Thus, in the communication member 63, the nozzle side part 29-1 is isolated from the movable portion side part 29-2 which continues to retract, and the inter-nozzle 28 retracts to the front surface of the blast nozzle 24, thereby opening the bullet supply port 62. FIG. 11B illustrates such a state, and the detail is enlarged in FIG. 10B.

Figure 12A:
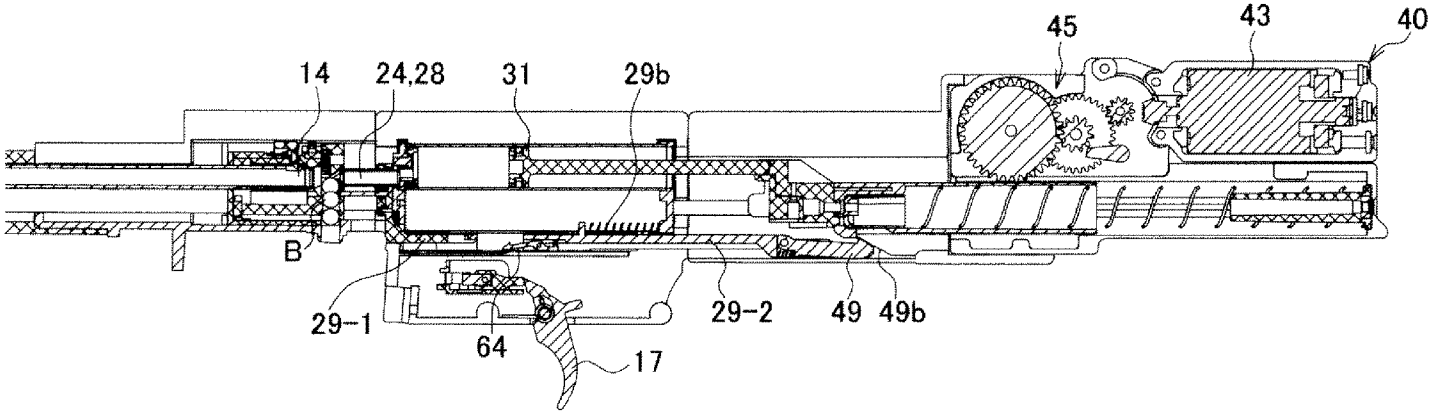
FIG. 12A is a sectional view illustrating a state immediately before a latch member is unlatched.
Figure 12B:
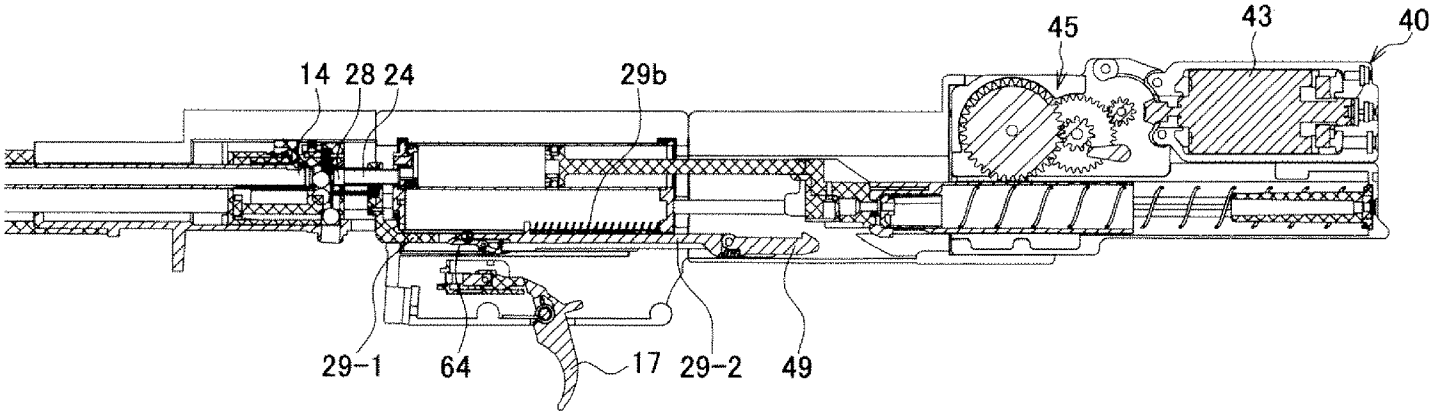
FIG. 12B is a sectional view illustrating a state where the communication member starts to advance after the latch member is unlatched.

Even after the nozzle side part 29-1 is isolated, the movable side part 29-2 being interconnected to the piston 31 and the like continues to retract. Meanwhile, the bullets B are pushed up through the open bullet supply port 62, are induced to the receiving portions 55 in three places tilting toward the rear of the receiving member 54, and stop. Due to the continuous retraction, the latch member 49 comes into contact with the disengagement portion 49*b* provided on the gun main body side, and due to the contact, the engagement is cancelled. Accordingly, the movable portion side part 29-2 is separated from the piston 31 and the like which are still retracting (FIG. 12A). As a result, the movable portion side part 29-2 switches over to advancing due to the action of the spring 29*b* and is integrated with the nozzle side part 29-1 again. Then, the nozzle side part 29-1 is pushed out forward (FIG. 12B).

Figure 13A:
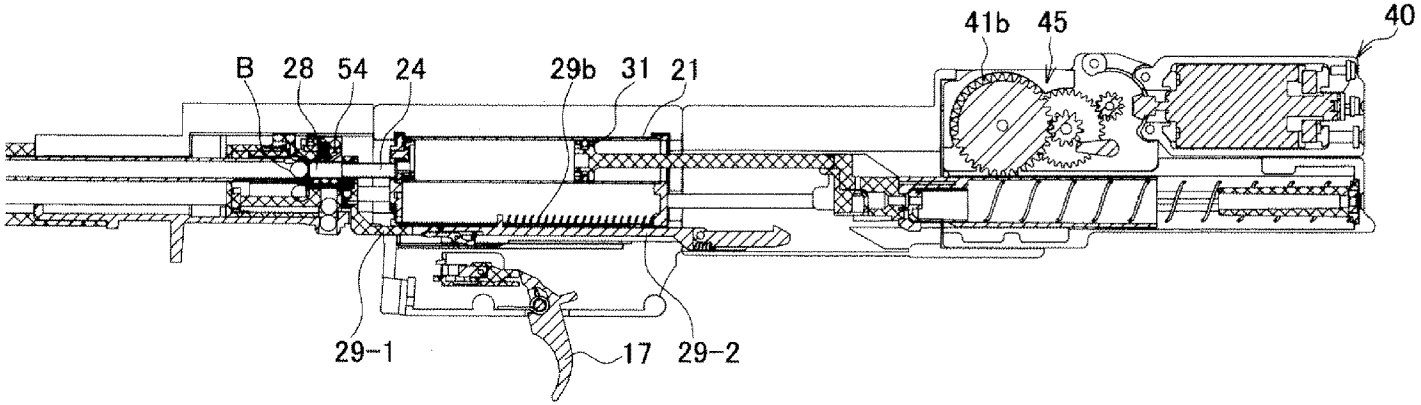
FIG. 13A is a sectional view illustrating a state where a cartridge portion is loaded with a bullet through an inner-nozzle in response to advance of the communication member.

The nozzle side part 29-1 moves forward, and the component of force acts on the receiving portion 55 in which the tip end of the inter-nozzle 28 at standstill abuts on the tilt. As a result, the receiving member 54 is pushed up, and the tip end of each inter-nozzle 28 pushes the bullet B into the cartridge portion 14 at the rear end of the barrel. In this case, when the inter-nozzle 28 first abuts on the bullet B, there is a possibility that biting will occur. Therefore, as described above, the receiving member 54 is configured to be pushed up once due to acting force, and then, the cartridge portion 14 is loaded with the bullet B (FIG. 13A).

Figure 13B:
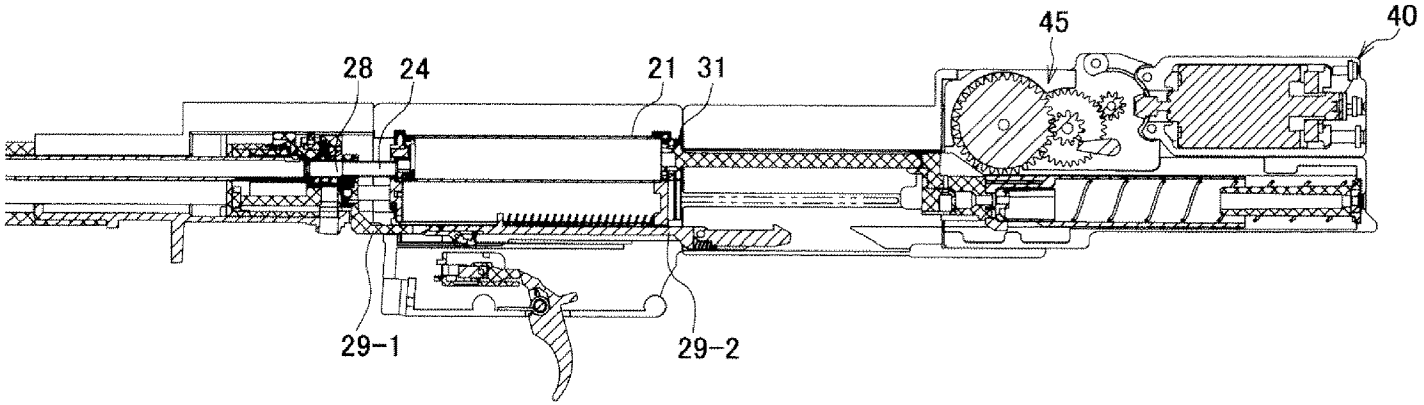
FIG. 13B is a sectional view illustrating a state after the bullet is shot.

When the output gear 41 further rotates and moves to the non-toothed portion 41*b*, the toothed portion 41*a* and the rack 36 are unmeshed, and pressure accumulated in the elastic member 42 is released at once (FIG. 13B illustrates a state where the piston 31 and the like have reached a retraction limit). Therefore, the piston assembly 30 instantly switches over to an advance state, and air inside the cylinders 21, 22, 23 is compressed, thereby blasting the three bullets B, B, B with the air from the three blast nozzles 24, 24, 24. As a result, all the bullets B escape from the state of being retained, in the cartridge portion 14, move into the barrels, and are shot from a gun point. In this manner, both the blast nozzle 24 and the inter-nozzle 28 configuring the nozzle have lengths approximately equal to each other, and the inner volume is not different from that of the nozzle in the related art. Thus, there is no possibility that power deteriorates.

The present invention has such a configuration in which the communication member 63 that transmits the operation of the movable portion 61 to the nozzle is divided into the movable portion side part 29-1 and the nozzle side part 29-2. The nozzle side part and the movable portion side part integrally retract so as to open the bullet supply port 62. After the nozzle side part is isolated from the movable portion side part which continues to retract, the open state is retained for a certain time. Thus, while the retracting distance of the nozzle remains to be approximately minimized, the open time for the bullet supply port is not lengthened. Thus, the present invention can be applied regardless of the form of a simulation gun, resulting in an epoch-making outcome in that the time required to supply a bullet can be minimized.

The invention claimed is:

1. A bullet supply port opening-closing device in a simulation gun which generates compressed air by operating a piston cylinder mechanism, blasts a bullet loaded in a barrel with the compressed air from a nozzle, and shoots the bullet, the bullet supply port opening-closing device comprising:

a communication member that causes the nozzle to retract in response to an operation of a movable portion of the piston cylinder mechanism and transmits the operation of the movable portion to the nozzle in order to open a bullet supply port leading to a space in front of the nozzle, wherein the communication member is constituted by a plurality of divided parts on a movable portion side and a nozzle side, and wherein a nozzle side part and a movable portion side part are configured to be able to be engaged with and disengaged from each other by an engagement mechanism such that the nozzle side part and the movable portion side part integrally retract so as to open the bullet supply port, after the nozzle side part is isolated from the movable portion side part which continues to retract, an open state is retained for a certain time, and the movable portion side part advances so as to be integrated with the nozzle side part, wherein the engagement mechanism comprises an engagement portion provided in the nozzle side part and a disengagement portion provided on a gun main body, and wherein the engagement portion has a pivot and is rotatably and pivotally supported by the pivot in the movable portion side part.

2. The bullet supply port opening-closing device in a simulation gun according to claim 1, wherein the communication member engages with the movable portion of the piston cylinder mechanism, a latch member which retracts together with the movable portion is included in the movable portion side part, and the nozzle side part configures a nozzle base having an inter-nozzle which is slidable in an air-tight manner with respect to the nozzle provided in a front portion of the piston cylinder mechanism.

3. The bullet supply port opening-closing device in a simulation gun according to claim 1, wherein the disengagement portion is positioned in a position at a predetermined distance behind a position of an advancing limit when the nozzle side part is present in the advancing limit, a distance between the position of the advancing limit where the nozzle side part is present and the position of the disengagement portion is maximally shortened, and a retention time for the open state of the bullet supply port is minimized.

4. The bullet supply port opening-closing device in a simulation gun according to claim 1, wherein the simulation gun has a plurality of barrels, and the certain time for the bullet supply port being open is a time required for the plurality of barrels to be loaded with the bullet.

5. The bullet supply port opening-closing device in a simulation gun according to claim 1, wherein the engagement portion engages with an engagement end of the nozzle side part at an engagement end in the front portion thereof.

* * * * *